US005368105A

United States Patent [19]

Chaiken et al.

[11] Patent Number: 5,368,105

[45] Date of Patent: Nov. 29, 1994

[54] CRYOGENIC SLURRY FOR EXTINGUISHING UNDERGROUND FIRES

[75] Inventors: Robert F. Chaiken; Ann G. Kim, both of Pittsburgh, Pa.; Andrew M. Kociban, Wheeling, W. Va.; Joseph P. Slivon, Jr., Tarentum, Pa.

[73] Assignee: The United States of America as represented by the Secretary of the Interior, Washington, D.C.

[21] Appl. No.: 805,223

[22] Filed: Dec. 11, 1991

[51] Int. Cl.[5] ..... A62C 3/02; F17C 5/00

[52] U.S. Cl. ..... 169/44; 169/46; 169/64; 62/54.1; 252/2; 252/8

[58] Field of Search ..... 252/2, 8; 62/54.1; 169/64, 46, 44

[56] References Cited

U.S. PATENT DOCUMENTS

| | | | |
|---|---|---|---|
| 3,830,307 | 8/1974 | Bragg et al. | 169/9 |
| 3,933,001 | 1/1976 | Muska | 62/47 |
| 4,488,407 | 12/1984 | Delano | 62/74 |
| 4,717,406 | 1/1988 | Giacobbe | 62/18 |

*Primary Examiner*—Richard D. Lovering
*Assistant Examiner*—Joseph D. Anthony
*Attorney, Agent, or Firm*—E. Philip Koltos

[57] ABSTRACT

A cryogenic slurry comprising a mixture of solid carbon dioxide particles suspended in liquid nitrogen is provided which is useful in extinguishing underground fires.

11 Claims, 1 Drawing Sheet

CRYOGENIC SLURRY FOR EXTINGUISHING UNDERGROUND FIRES

BACKGROUND OF THE INVENTION

1. Field of the Invention

The present invention relates so a liquid/solid slurry composition for extinguishing fires.

2. Prior Art

Previous use of liquids, either cryogenic (e.g. liquid $N_2$) or non-cryogenic (e.g. water), for extinguishing sub-surface fires has been limited by the problem of delivering the extinguishing agent to the fire. Liquids injected underground or below the surface of a porous refuse pile tend to flow downward due to gravity, rather than spread laterally and upward from the injection point. The liquid finds a channel of least resistance and tends to flow solely within that channel, often widening the channel as it flows. As a result, the liquid often will miss all or part of the fire zone, and, thus, the fire is seldom completely extinguished.

SUMMARY OF THE INVENTION

It is an object of the present invention to provide a liquid/solid slurry fire extinguishant which has improved delivery properties and to provide a method for extinguishing fires.

The present invention provides a cryogenic slurry comprising a mixture of solid carbon dioxide particles suspended in liquid nitrogen, the carbon dioxide particles and liquid nitrogen being present in a ratio of about 1:1 by weight.

The present invention also provides a method for making a cryogenic slurry useful as a fire extinguishant, the method comprising the steps of:

injecting liquid or gaseous carbon dioxide into a funnel shaped port of a nozzle to reduce the pressure on the carbon dioxide and form solid carbon dioxide particles;

injecting liquid nitrogen into the nozzle at a point downstream from where the liquid or gaseous carbon dioxide is injected;

mixing the solid carbon dioxide particles with the liquid nitrogen to form a slurry of solid carbon dioxide particles suspended in liquid nitrogen; and recovering the slurry.

The present invention also provides a method for extinguishing fires comprising the steps of:

injecting liquid or gaseous carbon dioxide into a funnel shaped port of a nozzle to reduce the pressure on one carbon dioxide and to form solid carbon dioxide particles;

injecting liquid nitrogen into the nozzle at a point downstream from where the liquid or gaseous carbon dioxide is injected;

mixing the solid carbon dioxide particles with the liquid nitrogen to form a slurry of solid carbon dioxide particles suspended in liquid nitrogen;

forcing the mixture of solid carbon dioxide and liquid nitrogen through a discharge line to extinguish a fire.

Other features and advantages of the invention will be set forth in, or apparent from, the following detailed description of preferred embodiments of the invention.

DETAILED DESCRIPTION OF THE INVENTION

Figure 2:
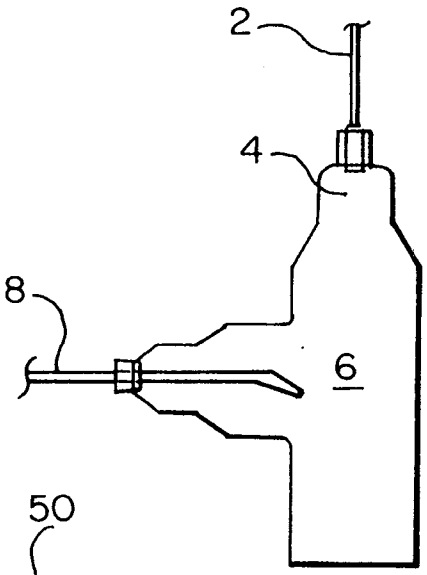
FIG. 2 is a more detailed view of a nozzle in the apparatus of FIG. 1.

The process of the present invention will now be described in detail with reference to the drawing figures.

Figure 1:
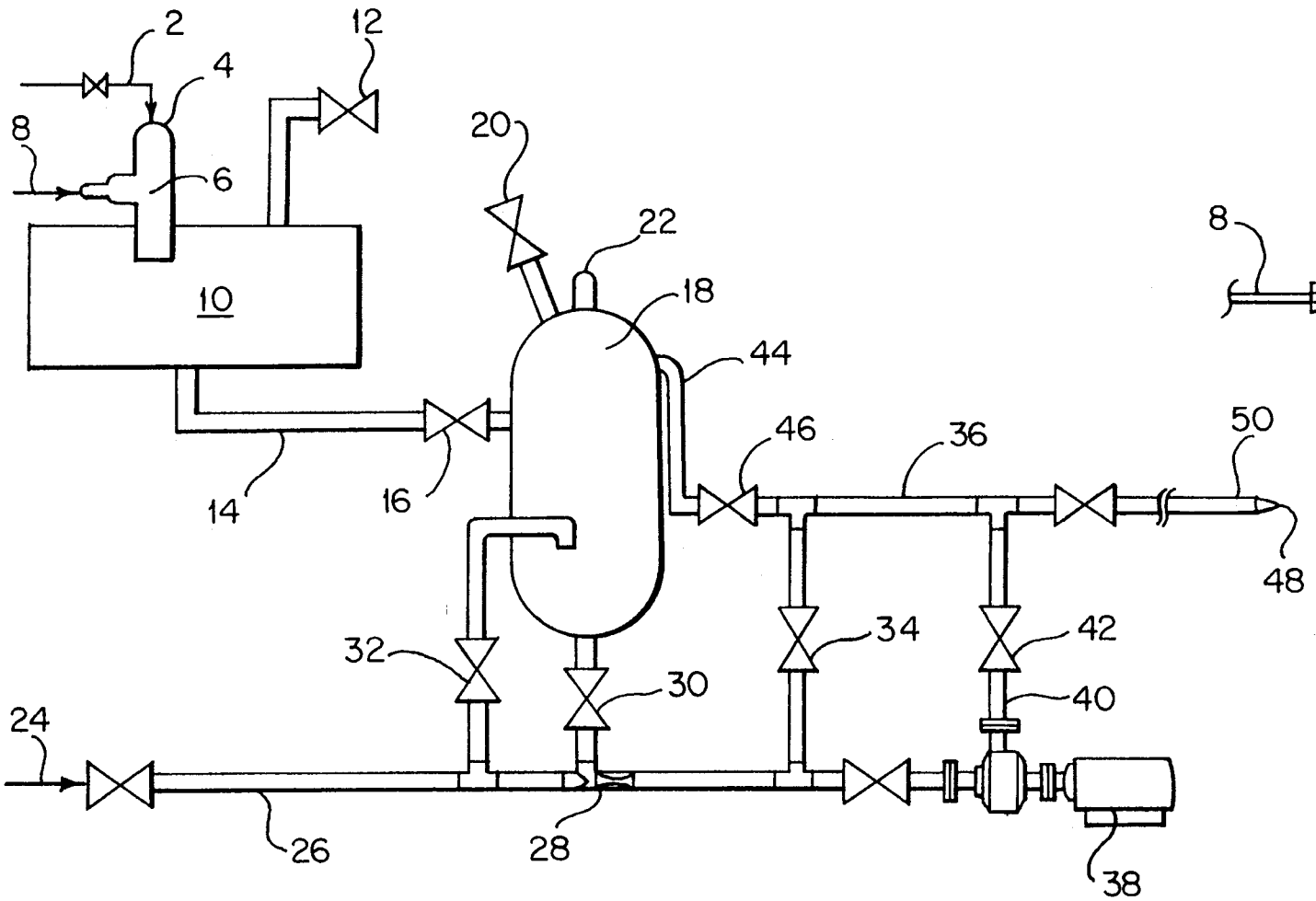
FIG. 1 is a diagrammatic side view of an apparatus that can be used to produce the cryogenic slurry of the present invention.

As normally available from commercial suppliers, carbon dioxide is delivered as a liquid or gas at elevated pressure and at a temperature much higher than the temperature of liquid nitrogen. Injecting liquid carbon dioxide directly into liquid nitrogen results in forming large chunks of solid carbon dioxide which quickly freezes in the delivery tube, thereby terminating the continued flow of carbon dioxide liquid. Therefore, as shown in FIG. 1, in the process of the present invention, liquid or gaseous carbon dioxide from a carbon dioxide supply indicated by arrow 2 is pumped through a funnel shaped port 4 of a nozzle 6, allowing the liquid or gaseous carbon dioxide to expand rapidly to form both carbon dioxide gas and finely powdered solid carbon dioxide particles. At the same time, liquid nitrogen indicated by arrow 8 is injected tangentially into the nozzle, forming a cold region within the nozzle which assists in cooling and condensing the gaseous carbon dioxide and the powdered carbon dioxide to liquid nitrogen temperatures, typically around −196° C. The entire condensed mixture (liquid nitrogen and particles of carbon dioxide which make up the slurry or slush) falls into a mixing tank 10, where the nitrogen and carbon dioxide are mixed to form a slurry. While the flow of nitrogen is normally sufficient to allow mixing of the nitrogen and carbon dioxide, the tank may include known mechanical mixing devices to mix the nitrogen and carbon dioxide. A vent 12 allows vaporized nitrogen from mixing tank 10 to be released.

A more detailed view of the nozzle 6 is shown in FIG. 2. Typically the carbon dioxide is injected into nozzle 6 at a pressure of about 350 psi and the nitrogen is injected into the nozzle at a pressure of about 50 psi. The funnel shaped port 4 increases in diameter at a rate of about one unit in diameter for every one unit in length until the port reaches a maximum diameter of about 4 times the width of the port at the point where the carbon dioxide is injected into the nozzle.

In the mixing tank, the liquid nitrogen to carbon dioxide ratio is preferably about 3.1 to 1.

From mixing tank 10 the slurry flows by gravity through a pipe 14 and a valve 16 into a holding tank 18. A valve 20 allows vaporized liquid nitrogen to be released, and the level of slurry in tank 18 can be monitored using a sight gauge 22. A second flow of nitrogen indicated by arrow 24 flows though a pipe 26 and through a jet pump 28 to pull the suspension out of holding tank 18 and downward through a valve 30. Preferably the second flow of nitrogen is at a pressure of about 80 psi. At a lower pressure, the slurry will have difficulty flowing and at a higher pressure, the amount of carbon dioxide present in the slurry coming from holding tank 18 will be reduced.

At the jet pump the liquid nitrogen to carbon dioxide ratio is preferably about 3.4 to 1 and this ratio remains relatively constant throughout the remaining downstream sections of the apparatus. The viscosity of the slurry is greater than about 0.15 centipoise and the density of the slurry is between about 55 and 65 lbs/cf.

A nitrogen wash down flow valve 32 is included in the apparatus to allow nitrogen from the second flow of nitrogen to be added to holding tank 18 when the holding tank needs additional cooling. However, in normal operation, valve 32 is closed.

In normal operation, the second flow of nitrogen 24 is sufficient to force the slurry upward through a pump bypass valve 34 and through the injection line 36. However, when additional pressure is needed, a centrifugal pump 38 can be used to exert pressure on the slurry through a pump discharge pipe 40 and valve 42. In normal operation, the valve 42 is closed.

A recycle line 44 and valve 46 are included in the apparatus to allow slurry and liquid nitrogen to flow back into holding tank 18 if there is a problem, such as a blockage, in injection line 36. In normal operation, valve 46 is closed.

The end of injection line 36 is preferably a closed and pointed probe 48 which allows injection line 36 to be inserted into an underground cavity and even driven into the wall of the cavity. One or more rows of holes 50 are located around the circumference of injection line 36 about ½" to 1" behind probe 48. Typically the holes are about 3/16" in diameter.

The cryogenic slurry of the present invention which is pumpable has good delivery characteristics. Upon being pumped into an underground cavity through holes 50, the slurry will start to flow through a preferred channel. As the liquid nitrogen evaporates, it leaves behind solid carbon dioxide deposited in the channel, temporarily increasing the channel resistance. With continued pumping the slurry will flow to another channel, repeating the process. Eventually, the slurry will flow in all directions around the point at which it is pumped into the underground cavity, uniformly saturating a large volume of the sub-surface region with slurry and/or solid carbon dioxide. The rapid evaporation of the liquid nitrogen and the slower sublimation of the solid $CO_2$ has several important attributes as a fire extinguishant.

To begin with, the slurry absorbs heat, cooling the burning material below its self-heating and/or ignition temperature. In addition, the slurry is relatively nonreactive and prevents the presence of oxygen in the subsurface burn zone, thereby preventing further heat generating oxidation processes from occurring.

The 700 fold increase in volume as the slurry converts to gas by evaporation (particularly the liquid nitrogen) acts as a piston pushing hot gaseous combustion products and air from the burn zone into the atmosphere. In this manner, heat is removed completely from the sub-surface burn zoned thereby cooling the burn zone more quickly than it would if the hot gases did not escape to the atmosphere. This piston effect is important in fighting underground fires where the heat energy tends to remain underground for long periods of time.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A process for extinguishing fires comprising the steps of:

injecting liquid or gaseous carbon dioxide into a funnel shaped port of a nozzle to reduce the pressure on the carbon dioxide and to form solid carbon dioxide particles;

injecting liquid nitrogen into the nozzle at a point downstream from where the liquid or gaseous carbon dioxide is injected;

mixing the solid carbon dioxide articles with the liquid nitrogen to from a slurry of carbon dioxide particles suspended in liquid nitrogen wherein the carbon dioxide particles and liquid nitrogen are present in a ratio of about 1:1 by weight; and forcing the mixture of solid carbon dioxide particles and liquid nitrogen through a discharge line to extinguish a fire.

2. The process of claim 1, wherein the liquid nitrogen cools the funnel shaped nozzle to a temperature of about −196° C. when it is injected into the nozzle.

3. The process of claim 1, wherein said process is a continuous process.

4. The process of claim 1, wherein a second flow of liquid nitrogen is used to force the slurry through the discharge line.

5. A cryogenic slurry comprising a mixture of solid carbon dioxide particles suspended in liquid nitrogen, said carbon dioxide particles and liquid nitrogen being present in a ratio of about 1:1 by weight.

6. The cryogenic slurry of claim 5, wherein said carbon dioxide particles are less than about 500 microns in size.

7. The cryogenic slurry of claim 5, wherein said cryogenic slurry has viscosity of greater than about 0.15 centipoise.

8. The cryogenic slurry of claim 5, wherein said cryogenic slurry has a density of about 55 to about 65 lbs/cf.

9. A process for making a cryogenic slurry comprising the steps of:

injecting liquid or gaseous carbon dioxide into a funnel shaped port of a nozzle to reduce the pressure on the carbon dioxide and to form a solid carbon dioxide particles;

injecting liquid nitrogen into the nozzle at a point downstream from where the liquid or gaseous carbon dioxide is injected;

mixing the solid carbon dioxide particles with the liquid nitrogen to form a slurry of carbon dioxide particles suspended in liquid nitrogen wherein the carbon dioxide particles and liquid nitrogen are present in a ratio of about 1:1 by weight; and recovering the slurry.

10. The process of claim 9, wherein the liquid nitrogen cools the funnel shaped nozzle to a temperature of about −196° C. when it is injected into the nozzle.

11. The process of claim 9, wherein said process is a continuous process.

* * * * *